US006457410B1

(12) United States Patent
Zerillo

(10) Patent No.: US 6,457,410 B1
(45) Date of Patent: Oct. 1, 2002

(54) METHOD AND APPARATUS FOR MAGNETICALLY CLAMPING PRINTING PLATES

(75) Inventor: Samuel D. Zerillo, Hillsboro, NH (US)

(73) Assignee: Presstek, Inc., Hudson, NH (US)

( * ) Notice: Subject to any disclaimer, the term of this patent is extended or adjusted under 35 U.S.C. 154(b) by 0 days.

(21) Appl. No.: 09/611,515

(22) Filed: Jul. 7, 2000

(51) Int. Cl.[7] ..... B41F 27/02

(52) U.S. Cl. ..... 101/389.1; 101/415.1; 101/378

(58) Field of Search ..... 101/415.1, 389.1, 101/409, 382.1, 385, 386, 389, 477, 378, 383

(56) References Cited

U.S. PATENT DOCUMENTS 3,581,257 A * 5/1971 Priessnetz ..... 101/382
3,670,646 A * 6/1972 Welch, Jr. ..... 101/389.1
4,138,102 A * 2/1979 Palmer ..... 101/389.1
4,528,906 A * 7/1985 Hasegawa ..... 101/127.1

* cited by examiner

*Primary Examiner*—Leslie J. Evanisko
(74) *Attorney, Agent, or Firm*—Testa, Hurwitz & Thibeault, LLP

(57) ABSTRACT

A printing plate is clamped to a plate support by providing the plate support with a magnetic surface and laying a printing plate having opposite edges on that surface. Then, a first strip-like ferromagnetic blade clamp is deposited on the plate so that the first blade clamp is adjacent and parallel to one edge of the plate and a second strip-like ferromagnetic blade clamp is deposited on the plate so that the second blade clamp is adjacent and parallel to the opposite edge of the plate. The magnetic attraction of the blade clamp to the support surface enables the blade clamps to releasably clamp the printing plate to the support surface. Dispensing mechanisms for depositing the blade clamps on, and removing them from, the support surface are disclosed. The invention has particular application to releasably clamping superimposed donor and receptor sheets to the plate cylinder of proofing apparatus.

12 Claims, 6 Drawing Sheets

METHOD AND APPARATUS FOR MAGNETICALLY CLAMPING PRINTING PLATES

BACKGROUND OF THE INVENTION

1. Field of the Invention

This invention relates generally to printing apparatus. It relates more particularly to a calamping mechanism for securing a printing plate to a plate cylinder.

2. Description of the Related Art

In offset lithography, an image is present on a printing plate as a pattern of ink-accepting and ink-repellant surface areas. In a typical sheet-fed offset press, the imaged plate is mounted to a plate cylinder where it is inked and then brought into contact with the compliant surface of a blanket cylinder. The blanket cylinder, in turn, applies the image to paper sheets which are brought into contact with the blanket cylinder by an impression cylinder.

It should be understood at the outset that nowadays a "printing plate" may actually be a thin, flexible plastic film or sheet.

Plates can be imaged on-press or, more traditionally on an off-press platesetter. A digitally operated platesetter includes an imaging cylinder to which the plate is initially mounted and which carries the plate past the head of the imaging device. That device transfers the image to the plate. The imaged plate is then removed from the platesetter and transferred to the plate cylinder of the printing press. When mounting an imaged plate to a plate cylinder for a press mount or when mounting a plate to an imaging cylinder for imaging, it is essential that the leading and trailing edges of the plate be secured firmly to the cylinder and that the plate be wrapped tightly around the cylinder. This ensures that there will be no relative movement between the plate and the cylinder when the cylinder is rotated.

A plate cylinder typically includes two plate clamps mounted to the cylinder that extend along its surface. To load a plate onto the cylinder, the leading edge of the plate is secured to the cylinder by one clamp and the plate is wrapped around the surface of the cylinder. The trailing edge of the plate is then secured to the cylinder with the other clamp.

Some printing processes require that two superimposed plates or sheets be mounted independently to the cylinder. For example, in color proofing apparatus, a receptor plate or sheet is secured to the cylinder by a first pair of clamps and successive donor plates or sheets representing color separations are secured to the cylinder over the receptor sheet by a second pair of clamps. After the donor sheet representing each color component has been imaged, that sheet is unclamped from the cylinder and replaced by the donor sheet corresponding to the next color component which must be wrapped around the cylinder and clamped. This process must be repeated three or four times for three or four color printing.

Various devices including hydraulic clamps, vacuum clamps, mechanical and electromechanical clamps have been developed over the years for holding a plate or sheet to a plate cylinder. However, for the most part, these prior devices have tended to be relatively complex. Also, in requiring heavy metal plates as clamps, they take up a relatively large amount of space on the plate cylinder creating a substantial "void" segment on the cylinder which is the space on the cylinder occupied by the clamps and the space immediately between them. Furthermore, the ancillary mechanisms for operating such clamps, such as air/hydraulic cylinders and lines thereto, take up additional space in the printing apparatus.

The above problems are exacerbated in the case of color proofing apparatus where four such clamps are required to secure the donor and receptor sheets to the cylinder.

The prior clamping devices are also disadvantaged in that the clamping mechanisms are fixed to the plate cylinders such that the mechanisms can only secure to the cylinder a plate or sheet having a specific length. Since the plates are often precut to fit the specific plate cylinder of the printing press, this inability to accommodate different length plates substantially increases the cost of operating and running printing and proofing apparatus.

SUMMARY OF THE INVENTION

Accordingly, it is an object of the present invention to provide a speedy and efficient clamping mechanism for clamping a printing plate to a plate cylinder or other support surface.

Another object of the invention is to provide a clamping device for clamping a plate or sheet to a cylinder which takes up a minimum amount of space on the cylinder.

A further object of the invention is to provide a clamping device which allows the associated cylinder to accept plates or sheets of different lengths.

Yet another object is to provide a clamping mechanism which minimizes void space on the cylinder.

Still another object of the invention is to provide a clamping mechanism which does not require bulky ancillary pumps or other apparatus to actuate the plate clamps.

An additional object of the invention is to provide a clamping mechanism of this type which is relatively simple and takes up a minimum amount of space in the imaging, proofing or printing apparatus in which it is installed.

Other objects will, in part, be obvious and will, in part, appear hereinafter. The invention accordingly comprises the features of construction, combination of elements and arrangement of parts which will be exemplified in the following detailed description, and the scope of the invention will be indicated in the claims.

Briefly, our clamping mechanism comprises at least one pair of similar clamping devices for clamping the leading and trailing edges of a plate or sheet preferably wrapped around a rotary cylinder. As alluded to above, in those applications requiring that a second plate or sheet be secured to the cylinder independently of the first, a second similar pair of clamping devices may be required. We will describe the invention as applied to a plate cylinder in an otherwise more or less conventional printing or proofing apparatus. It should be understood however that the invention is useful in other applications in which a thin plate or sheet has to be releasably clamped to a flat or curved surface of one kind or another.

In accordance with the invention, each clamping device is a long thin blade clamp and the cylinder (in whole or in part) and each blade clamp are made of ferromagnetic materials and at least one of the cylinder and clamps is magnetized so that the blade clamp is magnetically attracted to the cylinder with sufficient force to securely clamp the leading or trailing edge of the underlying plate or sheet to the cylinder.

In one embodiment of the invention, each blade clamp is laid down on and retrieved from the cylinder by a separate dispensing mechanism. More particularly, each blade clamp is wound up on a spool which may shuttle along a track extending parallel to the cylinder. The spool is movable along the track between a home position located just beyond one end of the cylinder and an extended position located just beyond the opposite end of the cylinder. The leading end of the blade clamp extending from the spool is terminated by a hook. When the spool is moved from its home position and passes by the adjacent confronting end of the cylinder, the hook engages that end of the cylinder. Resultantly, as the spool travels along the track, the blade clamp is paid out from the spool much like the steel tape of a tape measure, such that the blade clamp is laid down onto the surface of the cylinder (or more specifically onto the printing plate thereon) parallel to the cylinder axis.

When the spool reaches its extended position beyond the opposite end of the cylinder, the trailing end of the blade clamp is released from the spool so that the blade clamp is free to rotate with the cylinder, while the now empty spool remains at its extended position until it is time to unclamp the plate from the cylinder.

In order to unclamp the plate from the cylinder, the rotation of the cylinder is stopped and the cylinder is oriented to position the blade clamp on the cylinder so that its trailing end is aligned with the spool still reposing at its extended position on the track. Then, the spool is moved back along the track toward its home position. As will be described in more detail later, the trailing end of the blade is picked up by the spool and as the spool moves along the track towards home, the blade clamp is rewound onto the spool. This winding up of the blade clamp on the spool peels, rather than pulls, the blade clamp away from the cylinder. Therefore, the motion of the spool along the track is sufficient to overcome the strong magnetic attraction of the blade clamp to the cylinder. By the time the spool reaches the end of the cylinder adjacent to the home position of the spool, substantially the entire length of the blade clamp has been wound up on the spool. Then, as the spool travels the remaining distance to its home position, the hook at the leading end of the blade is released from the end of the cylinder so that the cylinder is again free to rotate independently of the clamping mechanism.

In a second embodiment of our invention, a single blade dispenser or applicator applies all of the blade clamps to, and removes them from, the plate cylinder. As such it is particularly suitable for use in proofing apparatus in which substantially superimposed donor and receptor sheets, drawn from a single roll of sheet material, are clamped to the proofer's imaging or plate cylinder. In other words, a first pair of blade clamps clamp the leading and trailing ends of the receptor sheet to the plate cylinder and, a second pair of blade clamps clamp the overlying donor sheet to that cylinder.

In this case, the blade dispenser comprises an elongated rotary applicator bar which extends parallel to the cylinder at a clamping station located adjacent to the cylinder. The bar has a polygonal cross-section in that it has a plurality of facets, the number of facets being at least equal to the number blade clamps to be dispensed, i.e. four in this case. In accordance with the invention, a magnet, which may be an electromagnet or a permanent magnet, is present at each facet of the applicator bar which, when operative, is sufficiently strong to attract and hold a blade clamp to the corresponding facet of the applicator bar. As will be described in detail later, the applicator bar may be rotated to selectively position each magnet, and any blade clamp magnetically adhered thereto, opposite the cylindrical surface of the plate cylinder. Also, the dispenser as a whole is movable toward and away from the plate cylinder between an extended position which locates the confronting magnet close to the cylinder surface and a retracted position in which that magnet is spaced away from the cylinder surface. All of the active components of the dispenser, along with the movement of the print cylinder, are controlled by a controller which may also control the other elements of the proofing apparatus.

Since the material for both the donor sheet and the receptor sheet are drawn from a single roll of sheet material, provision is made for separating the donor and receptor sheets from the roll supply after each sheet is wrapped around the plate cylinder and clamped. The dispenser includes a cutting device located at a cutting station adjacent to is the plate cylinder which can be brought into contact with the sheet material on the plate cylinder under the control of the controller at the appropriate times in the blade dispensing cycle as will be described in detail later.

To apply the donor and receptor sheets to the plate cylinder, with the dispenser in its retracted position, four blade clamps are releasably adhered to the applicator bar by the four magnets on that bar, the bar being oriented so that one blade clamp faces the plate cylinder. Then, proofing material from the supply roll is fed to the plate cylinder so that the material is draped over the cylinder with the leading edge of that material positioned between the plate cylinder and the confronting blade clamp on the applicator bar. Next, the dispenser is moved to its extended position so that the operative blade clamp is moved toward the plate cylinder whereby that blade clamp becomes magnetically attracted to the plate cylinder by a force that is stronger than the force holding that blade clamp to the applicator bar (or the electromagnet is deenergized). Then, the dispenser is retracted leaving the blade clamp clamping the proofing material to the plate cylinder.

Next, the controller controls the feeding of additional proofing material from the supply roll and rotates the plate cylinder so that the additional proofing material from the supply roll becomes wrapped around the plate cylinder, while at the same time the controller rotates the applicator bar to position a second blade clamp thereon opposite the plate cylinder. After the plate cylinder has rotated through a selected angle less than 360°, the plate cylinder is stopped and the dispenser is again moved to its extended position so that the second blade clamp is moved to the proofing material on the plate cylinder and becomes magnetically attracted to the cylinder. The magnet holding the second blade clamp to the applicator bar then releases the blade clamp to the cylinder and the dispenser is retracted leaving the second blade clamp clamping the proofing material to the plate cylinder.

At this point, the controller activates the cutting device which cuts the proofing material just behind the second blade clamp thereby separating the material on the cylinder from the roll supply. That segment of sheet material wrapped around and clamped to the plate cylinder constitutes a receptor sheet for the proofing apparatus and there is a gap between the leading and trailing edges of that sheet, i.e., between the first and second blade clamps.

Similar steps are repeated to apply a donor sheet to the plate cylinder over the receptor sheet. That is, with the dispenser in its retracted position, the applicator bar is rotated to position the third blade clamp adhered thereto opposite the plate cylinder and the plate cylinder is rotated to position the void space thereof opposite the third blade clamp. Also, proofing material is fed from the supply roll so that the leading edge thereof is introduced into the space between the plate cylinder and the third blade clamp. Next, the dispenser is moved to its extended position thereby moving third or operative blade clamp to the void space on the plate cylinder, the third blade clamp being magnetically attracted to that cylinder and released by the applicator bar. The dispenser is then moved to its retracted position and the applicator bar is rotated to position the fourth blade clamp opposite the plate cylinder. At the same time, the plate cylinder is rotated while additional proofing material is fed from the supply roll to the plate cylinder so that additional material overlies the just-applied receptor sheet.

Rotation of the plate cylinder is stopped when the void space thereon is disposed opposite the fourth blade clamp at which point the dispenser is again moved to its extended position so that the fourth blade clamp is released from the applicator bar to the plate cylinder thereby clamping the sheet material to the plate cylinder. Following retraction of the dispenser, the cutting device is activated to sever the sheet material just behind the fourth blade clamp thereby separating the outer layer of sheet material wrapped around the plate cylinder, which constitutes a donor sheet, from the supply roll which roll may then be rotated in the opposite direction to remove the leading edge of the roll supply from the vicinity of the plate cylinder.

With the donor and receptor sheets firmly clamped to the plate cylinder, the proofing apparatus can now be operated to process the sheets in a manner known in the art.

After the proofing operation is completed, the blade dispenser may be operated to remove the blade clamps, in reverse order, from the plate cylinder so as to release only the donor sheet or both sheets from the cylinder. That is, with the dispenser in its retracted position and with one of the magnets on the applicator bar facing the plate cylinder, the plate cylinder is rotated to position the fourth blade clamp opposite the applicator bar and the dispenser is moved to its extended position. If the magnets on the applicator bar are electromagnets, the operative magnet is energized and produces a magnetic field that is stronger than that of the magnetized plate cylinder. Resultantly, the fourth blade clamp becomes attracted to that magnet so that when the dispenser is retracted, the fourth blade clamp is pulled away from the plate cylinder thereby releasing the trailing end of the outer donor sheet. The plate cylinder is then rotated to position the third blade clamp opposite the applicator bar and the applicator bar is rotated to orient a second electromagnet opposite the plate cylinder. Then, the dispenser is extended again and that electromagnet is energized to pick up the third blade clamp from the plate cylinder thereby releasing the leading end of the donor sheet.

If the magnets on the applicator bar are permanent magnets, a stripper mechanism to be described later is inserted under one end of the blade clamp being removed from the cylinder and is moved along under the blade clamp. Resultantly, the blade clamp is progressively moved away from the cylinder a distance such that it has a stronger attraction for the confronting magnet on the applicator bar than for the cylinder. Thus, after the stripper mechanism moves to the opposite end of the blade clamp, the entire blade clamp will have been released by the cylinder to the applicator bar.

Once the clamps holding the donor sheet have been removed as aforesaid, the donor sheet must be removed from the cylinder and replaced by another donor sheet representing another color component which new sheet may then be clamped to the cylinder as described above.

Alternatively, the above procedures may be repeated to remove the second and then the first blade clamp from the plate cylinder thereby unclamping the inner receptor sheet so that both the donor sheet and receptor sheet can be removed from the plate cylinder at the end of a proofing operation.

It should be appreciated from the foregoing that the blade clamp component of our clamping mechanism can be quite thin and only wide enough to provide the necessary magnetic attraction to effectively clamp the leading or trailing edge of the underlying plate to the cylinder. The blade clamp can be laid down anywhere around the circumference of the cylinder simply by properly orienting the cylinder and activating the clamping mechanisms at the proper times.

As will become apparent, the clamping mechanisms utilized to lay down and pick up each blade clamp are relatively simple and occupy a minimum amount of space. Furthermore, they are quite fast and efficient and are relatively easily incorporated into otherwise conventional printing and proofing apparatus.

BRIEF DESCRIPTION OF THE DRAWINGS

For a fuller understanding of the nature and objects of the invention, references should be had to the following detailed description taken in connection with the accompanying drawings, in which.

DETAILED DESCRIPTION OF ILLUSTRATIVE EMBODIMENTS

Figure 1:
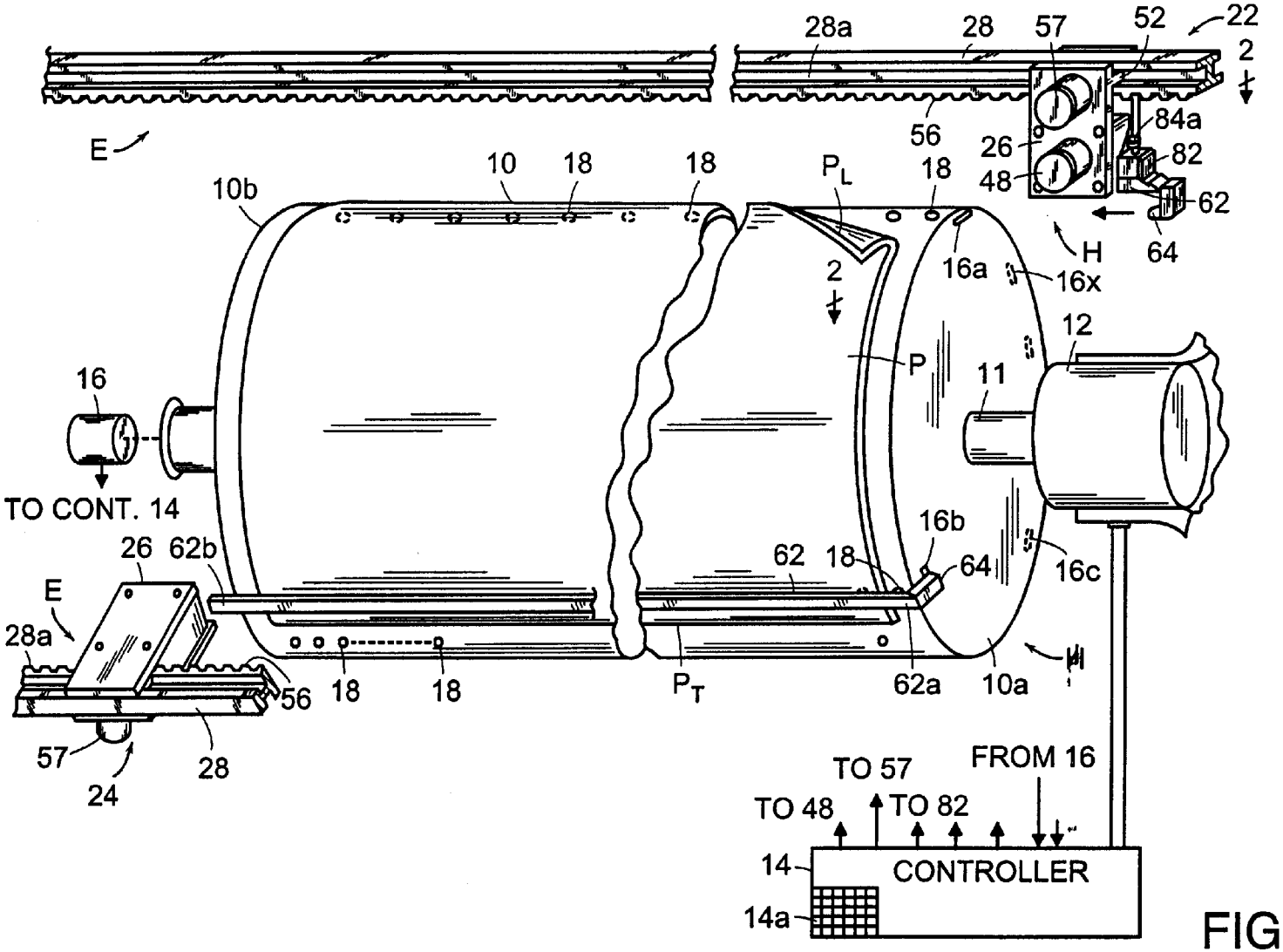
FIG. 1 is a fragmentary perspective view of a pair of clamping mechanisms for clamping the leading and trailing ends of a printing plate to a support surface, to wit: a plate cylinder.

Refer to FIG. 1 of the drawings which show a rotary cylinder 10 whose shaft 11 may be rotated by a motor 12 under the control of a programmable controller 14 having a keyboard 14*a* for entering instructions into the controller. The controller receives signals from a shaft encoder 16 or the equivalent which enables the controller to monitor the angular position of cylinder 10 and to set cylinder 10 at selected angular positions about its axis. Cylinder 10 may be part of an imaging; printing or proofing apparatus and is arranged to support a flexible sheet such as a printing plate P which may be wrapped around cylinder 10 when the cylinder is stationary.

For reasons that will become apparent, arcuate slots 16*a*, 16*b*. . . 16*x* are formed in one end 10*a* of cylinder 10. Also, a lengthwise series of small spaced-apart magnets 18 are inserted into the cylindrical surface of cylinder 10 in alignment with each slot 16*a*, 16*b* . . . 16*x*. Alternatively, the cylinder surface itself may be magnetized.

In order to clamp the leading edge $P_L$ of the plate P to the cylinder, a first clamping mechanism shown generally at 22 is provided adjacent to cylinder 10. A second clamping mechanism 24 is located adjacent to the cylinder in order to clamp the trailing edge $P_T$ of the plate to the cylinder. For ease of illustration, mechanisms 22 and 24 are shown spaced about 120° around the axis of cylinder 10. In actuality, they may be spaced much further apart to maximize the length of the plate P that can be clamped to cylinder 10 and to minimize the amount of void space on the cylinder. Aside from their angular positions relative to cylinder 10, the clamping mechanisms 22 and 24 are substantially identical. Therefore, we will only describe mechanism 22 in detail.

Mechanism 22 comprises a blade dispenser 26 arranged to travel back and forth on a stationary track 28 extending parallel to cylinder 10 between a home position H located just beyond a first end 10*a* of cylinder 10 and an extended position E located just beyond the opposite end 10*b* of the cylinder. In FIG. 1, the blade dispenser 26 of mechanism 22 is shown at its home position H, while the dispenser 26 of mechanism 24 is illustrated at its extended position E.

Figure 2:
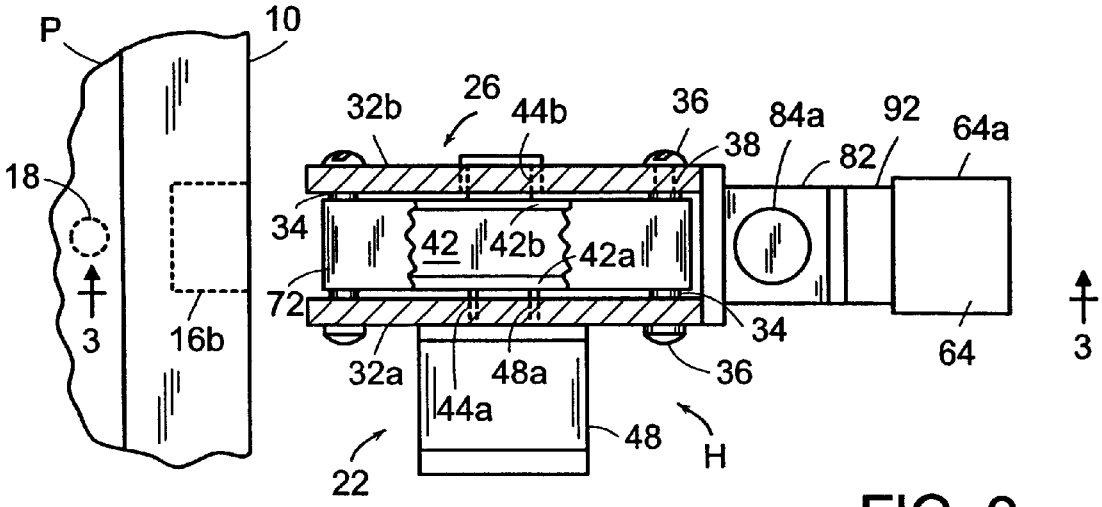
FIG. 2 is a plan view taken along line 22 of FIG. 1, on a larger scale and with parts broken away, showing in greater detail the blade clamp dispenser of the FIG. 1 clamping mechanism reposing at its home position.
Figure 3:
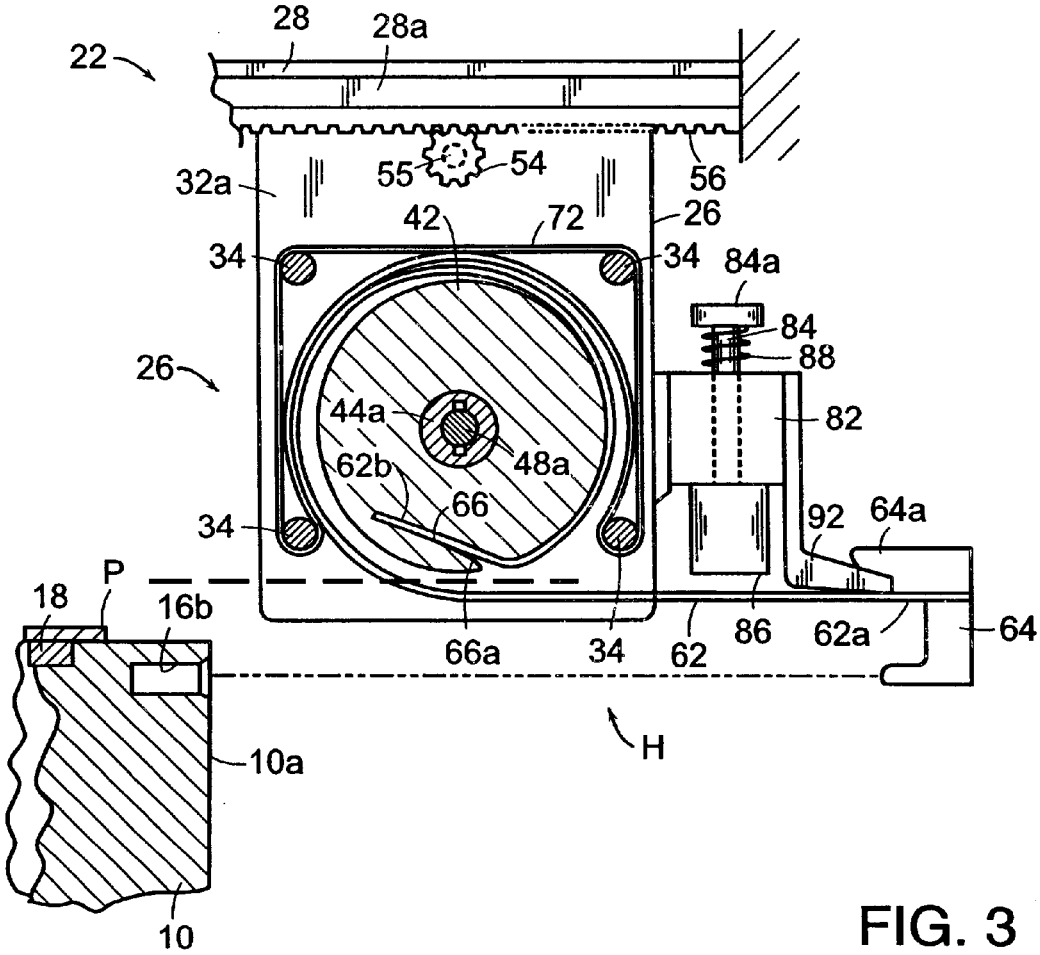
FIG. 3 is a sectional view taken along line 33 of FIG. 2.

As best seen in FIGS. 2 and 3, dispenser 26 of mechanism 22 comprises a pair of mirror-image, generally rectangular side walls 32*a* and 32*b* which are held in spaced relation by posts 34 adjacent to the four corners of the side walls. The posts are retained by threaded fasteners 36 which extend through the side walls and are turned down into threaded holes 38 (FIG. 2) in the ends of the posts.

Positioned between side walls 32*a* and 32*b* is a spool 42 having stub shafts 44*a* and 44*b* journalled in the dispenser side walls 32*a* and 32*b* so that spool 42 can be rotated about an axis relative to the dispenser walls. In the illustrated embodiment, spool 42 is rotated by a reversible step motor 48 mounted to side wall 32*a* and whose shaft 48*a* is rotatably coupled to stub shaft 44*a*. Preferably, motor 48 is a step motor which is energized by signals from the controller 14 shown in FIG. 1.

Referring now to FIGS. 1 to 3, track 28 includes longitudinal slides 28*a* formed in the opposite sides of the track which slides are slidably engaged by slides 52 present at the tops of housing walls 32*a* and 32*b*, respectively. As shown in FIG. 3, dispenser 26 is moved along track 28 by a pinion 54 at the end of a shaft 55 rotatably mounted to housing walls 32*a* and 32*b* and arranged to mesh with a rack 56 formed at the underside of track 28. Shaft 55 is rotated by a reversible step motor 48 mounted to housing wall 32*a* above motor 48. The motor 48 is also controlled by controller 14. In other words, when motor 54 is rotated in one direction or the other by controller 14, dispenser 26 is caused to move in one direction or the other along track 28.

As best seen in FIGS. 2 and 3, spool 42 is arranged to support the coiled length of a thin, flexible blade clamp 62. The clamp has a leading end 62*a* to which is attached a hook 64 and a trailing end 62*b* (FIG. 3) arranged to engage in a slot 66 extending along a chord of spool 42. Preferably, slot 66 has a relatively wide mouth or entrance 66*a* at the periphery of spool 42 to facilitate the entry of the blade end 62*b* into slot 66 as will be described later.

When the trailing end 62*b* of blade clamp 62 is captured in slot 66 and spool 42 is rotated clockwise as viewed in FIG. 3, the clamp 62 is wound up on spool 42. As we shall see, this occurs when dispenser 26 moves from left to right in FIG. 1, i.e., from its extended position E to its home position H. Preferably, spool 42 is provided with side flanges 42*a* and 42*b* as shown in FIG. 2 in order to center the blade on the spool. Desirably also, an endless band 72 of flexible material is looped around posts 34 between housing side walls 32*a* and 32*b* such that an inner stretch of the band conforms to the perimeter of the spool and no material extends between the two posts 34 closest to cylinder 10 as shown in FIG. 1. Thus, when spool 42 is rotated clockwise, the blade 62 may be drawn into the dispenser 26 between those lower posts 34 with the inner stretch of band 72 causing the blade clamp 62 to wind up tightly on the spool.

Figure 5:
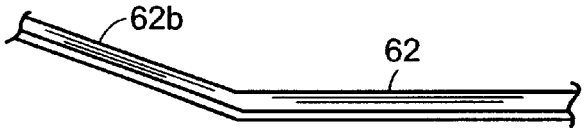
FIG. 5 is a fragmentary perspective view on a still larger scale showing a blade clamp embodiment in greater detail.

Preferably, the blade clamp 62 has a slight crown as shown in FIG. 5 so that it can only be rolled up in one direction, i.e., like the metal tape of a tape measure.

Of course, when spool 42 is rotated counterclockwise as viewed in FIG. 3, which occurs when dispenser 26 moves from right to left in FIG. 1, i.e., from home position H to the extended position E, the blade clamp 62 is unwound from spool 42 and paid out from dispenser 26. dispenser side walls 32*a* and 32*b* just above the point where the blade clamp 62 enters and leaves the dispenser 26. Actuator 82 includes a shaft 84 whose lower end supports a magnet 86 facing blade clamp 62. The shaft and magnet are biased away from the blade clamp 62 by a coil spring 88 encircling shaft 84 between the actuator body and a cap 84*a* at the upper end of the shaft. Normally, the magnet 86 is biased away from the blade clamp 62 by spring 88 as shown in FIG. 3. However, when the actuator 82 is energized by signals from controller 14, the shaft is extended to bring the magnet 86 into contact with the blade clamp 62 as shown in phantom in FIG. 4 for reasons that will become apparent.

The dispenser 26 of clamping mechanism 24 shown at its extended position E in FIG. 1, has the same components as mechanism 22 and operates in the same way as described above under the control of controller 14.

Usually when cylinder 10 is not being used, the dispenser 26 of both clamping mechanisms 22 and 24 are located at their respective home positions H just beyond the cylinder end 10*a* with each blade being wound up on its respective spool 42. Preferably, when each dispensers is so parked, a nose 64*a* on hook 64 engages a ramp 92 projecting from actuator 82 to retain the leading end 62*a* of each blade clamp 62.

When the apparatus with which cylinder 10 is associated is to be used, a plate P is wrapped around the cylinder as shown in FIG. 1 so that the leading end $P_L$ of the plate is located opposite the cylinder slot 16*a*. Then, the cylinder is rotated by motor 12 under the control of controller 14 from information put in via its keyboard 14*a* to position the cylinder slot 16*a* opposite the blade hook 64 of clamping mechanism 22. As soon as the cylinder 10 is correctly positioned, controller 14 may activate the motor 57 of that mechanism's dispenser 26 causing the dispenser to move along its track 28 away from its home position H. When the dispenser passes over the cylinder end 10*a*, the hook 64 at the leading end of the blade clamp 62 engages in the slot 16*a* in the cylinder end 10*a* thereby securing the leading end of the blade clamp to the cylinder. At the same time, controller 14 activates the spool motor 48 of mechanism 22 so that the spool 42 in the dispenser rotates counterclockwise whereupon the blade clamp is paid out from the dispenser as the dispenser moves along the cylinder. Since the radius of the spooled blade clamp in the dispenser decreases as the dispenser moves along its track, the speed of each spool motor 48 is increased by controller 14 to compensate for that fact.

In accordance with the invention, the blade clamp 62 is of a ferromagnetic material and is attracted to the magnets 18 embedded in cylinder 10 (or to the surface of the cylinder) under the plate leading edge $P_L$ thereby firmly clamping that leading edge to the cylinder surface.

Figure 4:
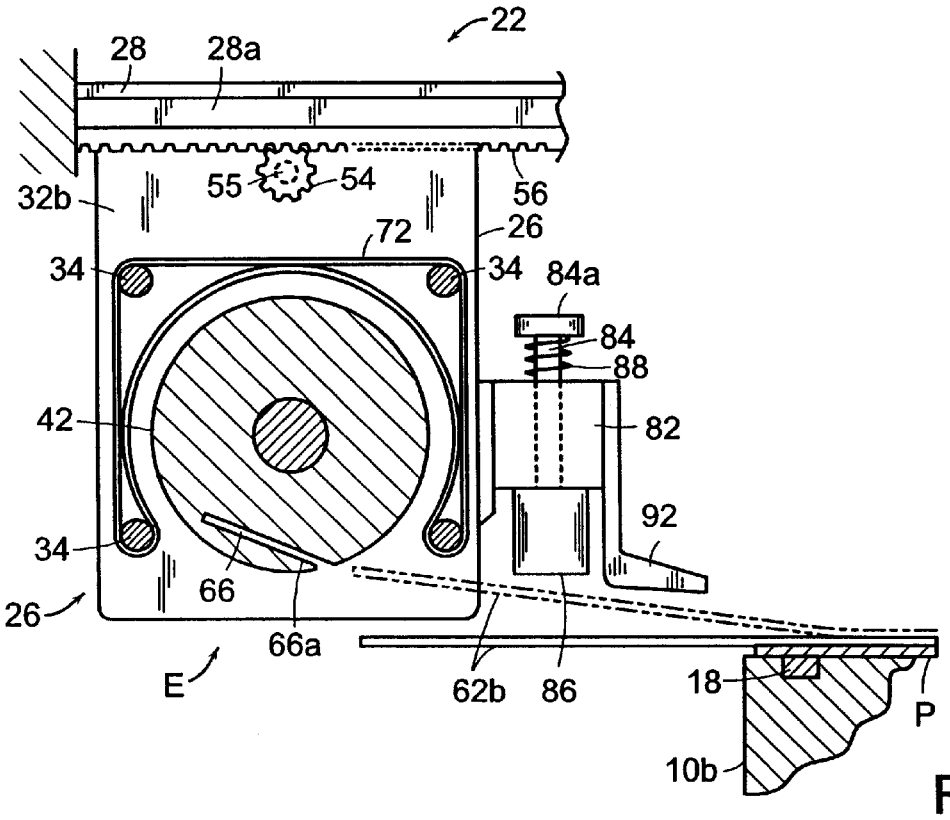
FIG. 4 is a view similar to FIG. 3 showing the blade clamp dispenser in its extended position.

After the dispenser 26 of mechanism 22 has passed the cylinder end 10*b* and approaches its extended position E, the dispenser will have traveled a distance greater than the length of the blade clamp 62. Resultantly, the trailing end 62*b* of the blade clamp 62 pulls out of its slot 66 in dispenser spool 42 and overhangs cylinder end 10*b* as best seen in FIG. 4. Thus, the blade clamp is separated from its dispenser and is free to rotate with cylinder 10.

When the dispenser 26 reaches its extended position E shown in FIG. 4, a limit switch there (not shown) sends a signal to controller 14 whereupon the controller deactivates motors 48 and 57 of mechanism 22. Dispenser 26 remains in position E until it is time to retrieve the blade clamp 62 from cylinder 10.

After the leading end $P_L$ of plate P has been clamped to cylinder 10 as aforesaid, the controller 14 rotates the cylinder clockwise as viewed in FIG. 1 to position the slot in the cylinder end 10*a* that underlies the trailing end $P_T$ of the plate, i.e., slot 16*b* in FIG. 1, so that that slot is opposite the clamping mechanism 24 and more particularly opposite the blade hook 64 of that mechanism which, as noted above, is in its home position H.

Next, controller 14 activates the motor 57 (and motor 48) of mechanism 24 causing that mechanism to move away from its home position H toward the cylinder end 10*a*. When the dispenser passes end 10*a*, the hook 64 engages in slot 16*b* and, as a result, that mechanism's blade clamp 62 is paid out from the dispenser and laid down over the trailing end $P_T$ of the plate as shown in FIG. 1. As the dispenser 26 of mechanism 24 approaches its extended position E as shown in FIG. 1, the trailing end 62*b* of the corresponding blade clamp 62 is released from the dispenser so that it overhangs the cylinder end 10*b* as shown in that figure. When the dispenser does reach its position E, it trips a limit switch (not shown) causing controller 14 to turn off the motor 57 (and motor 48) of mechanism 24. Now both dispensers repose in their extended positions so that both blade clamps 62 are free to rotate with cylinder 10 as a scanning or imaging operation is performed on plate P by the associated imaging or printing apparatus.

After the plate P has been processed and the cylinder 10 is brought to a stop, controller 14 may be programmed to rotate the cylinder to position the blade clamp 62 at the leading end $P_L$ of the plate opposite the dispenser 26 of clamping mechanism 22 which dispenser is still at its extended position E. When cylinder 10 is properly oriented, the overhanging trailing end 62*b* of that blade clamp is located directly under that mechanism's magnet 86 and ramp 92 as shown in FIG. 4. At this point, controller 14 energizes the actuator 82 of dispenser 26 momentarily causing the actuator 82 to move magnet 86 into contact with the blade end 62*b* as shown in dotted lines in FIG. 4. Resultantly, the blade end is attracted to the magnet so that when the magnet is retracted by spring 88, the blade end is pulled up by the magnet thereby aligning the bitter end of the clamp with the mouth 66*a* of slot 66 in spool 42.

Controller 14 now activates motor 57 of dispenser 26 causing the motor pinion 54 to rotate in a direction that moves dispenser 26 away from position E toward cylinder 10. The magnetic attraction of the blade end 62*b* to magnet 86 and the magnet/blade frictional forces are such that the magnet can slide along the top of the blade clamp while keeping the blade end aligned with the mouth 66*a* of slot 66. As dispenser 26 passes over blade end 62*b*, the blade end is inserted into slot 66. At this point, the controller 14 activates motor 48 (FIG. 1) of dispenser 26 so that the motor rotates spool 42 clockwise as viewed in FIG. 4 thereby rolling up the blade clamp 62, trailing end first, on spool 42. As the blade clamp is rolled up, it is incrementally peeled, rather than pulled, from plate P. Therefore, the winding action of the traveling spool 42 suffices to overcome the magnetic attraction of the blade clamp to the cylinder as the dispenser 26 progresses along track 28 toward its home position H in FIG. 1.

As the dispenser 26 passes the cylinder end 10*a*, just before it reaches its home position H, the hook 64 of the now almost wound up blade clamp 62 is disengaged from its slot 16*a* in cylinder 10 so that by the time the dispenser reaches its home position H, the blade clamp has been wound up on spool 42 sufficiently to park the nose 64*a* of hook 64 on that dispenser's ramp 92.

With the plate leading end $P_L$ having been released from the cylinder 10, controller 14 rotates the cylinder to position the blade clamp 62 at the trailing end $P_T$ of the plate opposite the clamping mechanism 24. The dispenser 26 of mechanism 24 can then be moved under the control of controller 14 to its home position in the same fashion just described to peel away the blade clamp 62 from the trailing end $P_T$ of the plate P thereby enabling the plate to be removed from the cylinder 10.

In some applications, the trailing end segment of each blade clamp 62 may be bent upwardly as shown in FIG. 5 so that when the blade clamp is magnetically adhered to cylinder 10, the trailing end 62*b* is in alignment with the mouth 66*a* of the spool slot 66. In that event, the actuator 82 and magnet 86 of dispenser 26 may not be needed.

It will be appreciated from the foregoing that our magnetic blade clamp may be laid down and removed quite quickly thereby minimizing the time required to clamp a sheet or plate to a cylinder or other support surface. The clamping mechanism is quite compact and therefore easy to incorporate into more or less conventional printing apparatus. Furthermore, the blade clamp itself is quite small thereby minimizing void space on the cylinder around which the plate is wrapped. Finally, the clamping mechanism is able to clamp to the cylinder plates a sheet or plate having a wide variety of different lengths. This simply involves programming the controller to orient cylinder 10 so that the appropriate slot 16*b*, 16*c*, etc. is aligned with the mechanism 24 that lays down and removes the blade clamp at the trailing end $P_T$ of the plate.

It should also be appreciated that if the cylinder 10 will only handle plates P of a fixed length, controller 14 can be programmed to position two cylinder slots, e.g., 16*a* and 16*b*, opposite clamping mechanisms 22 and 24, respectively, and to operate both mechanisms simultaneously so that both clamps can be laid down and picked up at the same time.

Figure 6:
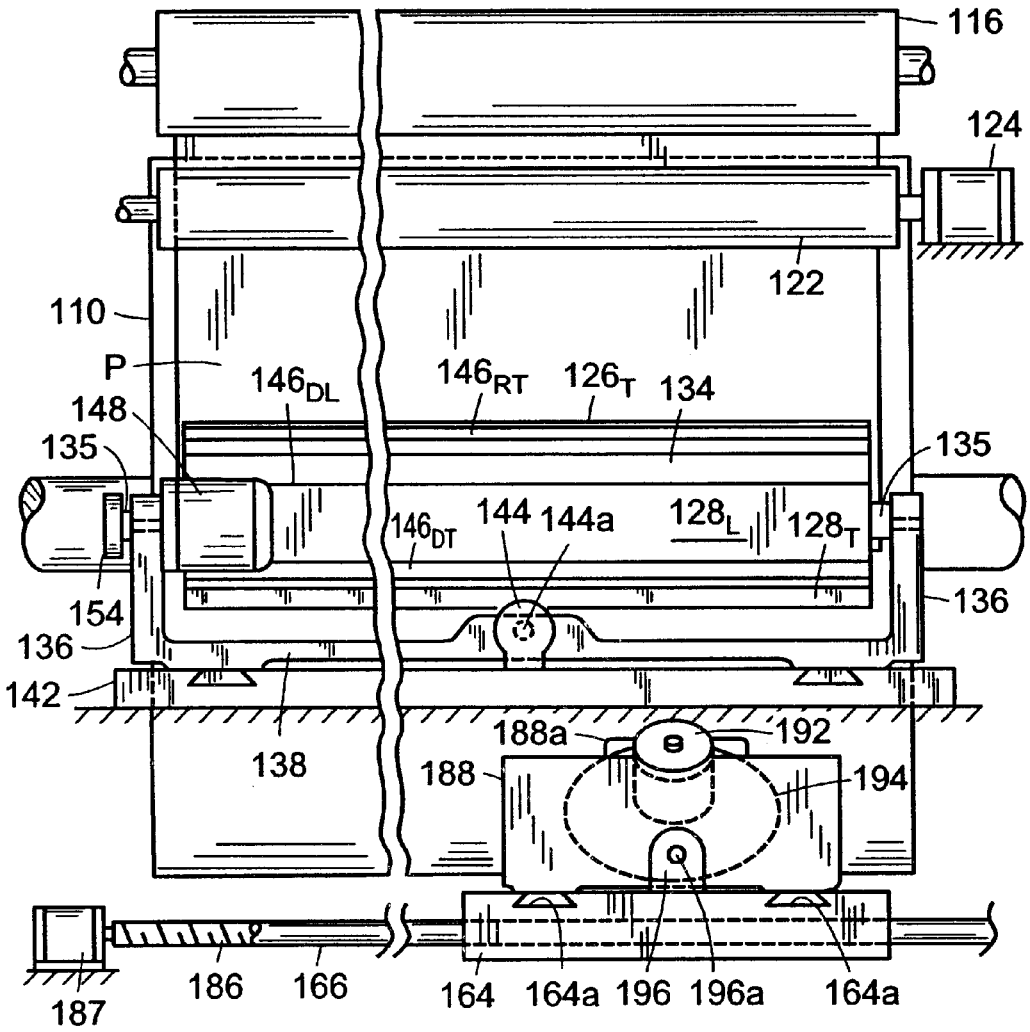
FIG. 6 is a front elevational view with parts broken away showing proofing apparatus incorporating a second embodiment of our magnetic clamping mechanism.
Figure 6:
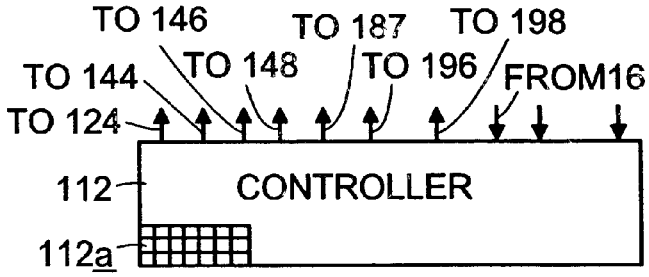
Figure 7:
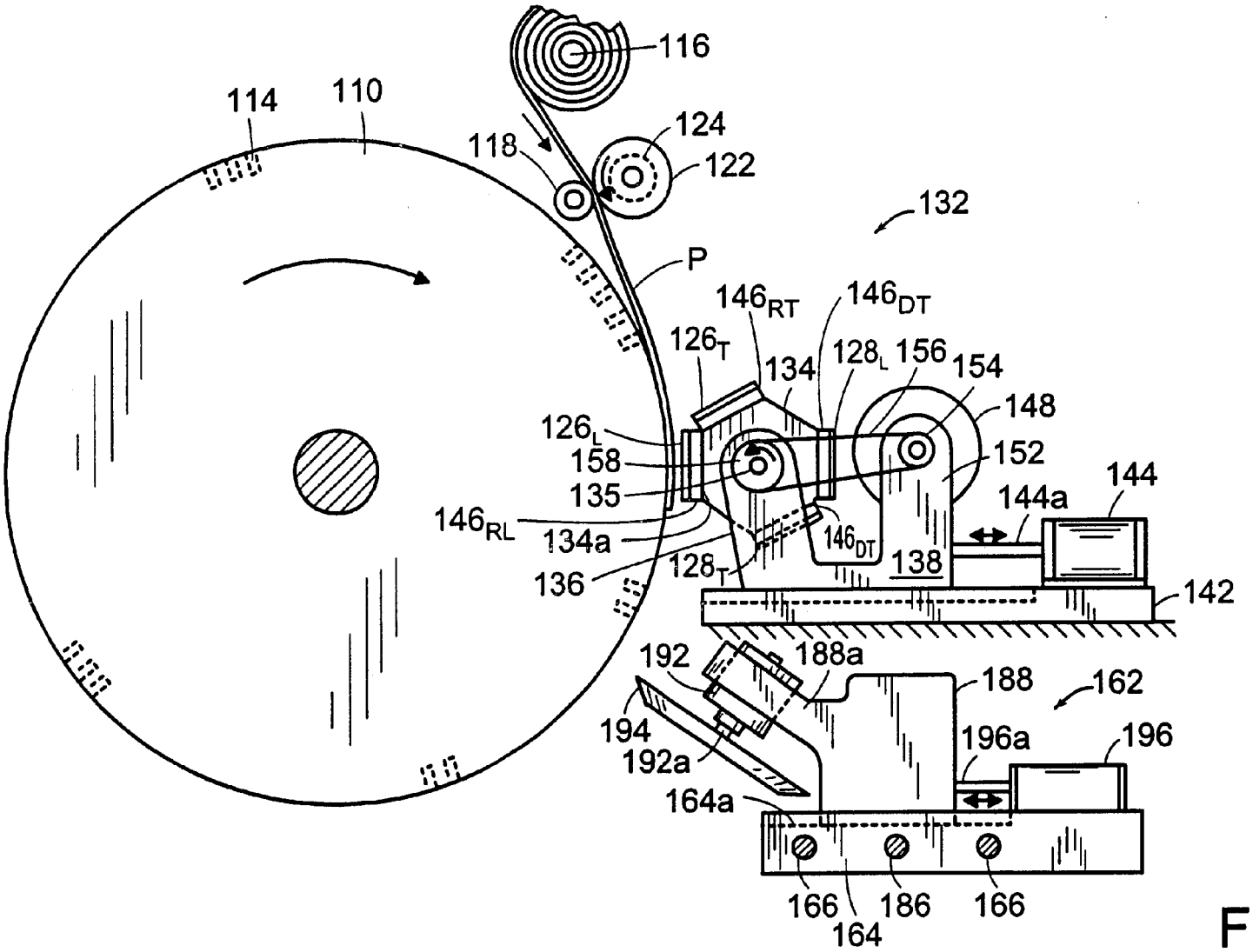
FIG. 7 is an end view thereof.

Refer now to FIGS. 6 and 7 which illustrate proofing apparatus incorporating magnetic blade clamps for clamping superimposed donor and receptor sheets to the plate cylinder of that apparatus and a single blade dispenser or applicator for applying all the blade clamps to, and removing them from, the plate cylinder of that apparatus. As shown there, the proofing apparatus comprises a driven rotary plate cylinder 110 which is similar to cylinder 10 described above in that it is controllably rotated by a controller 112 having a keyboard 112*a*. Also, the cylindrical surface of the cylinder is magnetically attractive due to the rows of small cylindrical magnets 114 recessed into that surface of the cylinder, which rows, as with cylinder 10, may extend around substantially the entire circumference of the cylinder. Alternatively, the entire surface of the cylinder may be of a magnetized material.

Cylinder 110 is adapted to support printing material P drawn from a supply roll 116 and fed to the surface of the cylinder via a roll couple consisting of a pinch roller 118 and a feed roller 122 rotated by a motor 124 under the control of controller 112.

Figure 9:
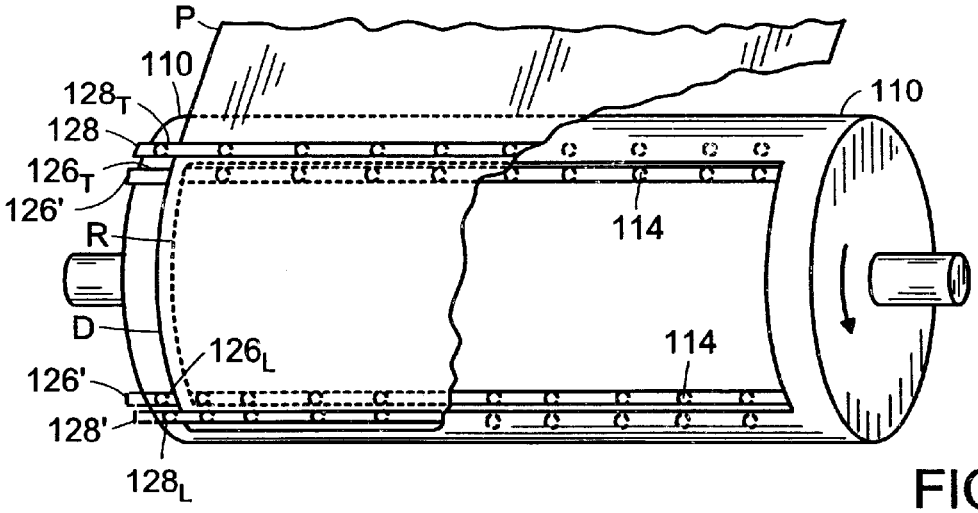
FIG. 9 is a diagrammatic view showing the placements of the blade clamps on the plate cylinder of the FIG. 6 apparatus.

Referring for a moment to FIG. 9, the material P drawn from roll 116 (FIG. 7) is adapted to be wrapped around cylinder 110 to provide a receptor sheet R thereon. After the leading and trailing edges of the receptor sheet are clamped to the cylinder by blade clamps $\mathbf{126}_L$ and $\mathbf{126}_T$, respectively, the receptor sheet R is separated from the roll supply. Then, additional material P, drawn from roll 116, is wrapped around the cylinder to provide a donor sheet D which overlies the receptor sheet R. The leading and trailing edges of the donor sheet are also clamped to cylinder 110 by a second pair of blade clamps $\mathbf{128}_L$ and $\mathbf{128}_T$, respectively. The donor sheet is then separated from the roll supply, leaving superimposed donor and receptor sheets wrapped around cylinder 110, which sheets may then be processed in a known way by the associated proofing apparatus. For ease of illustration the donor and receptor sheets are shown as occupying only a small sector of cylinder 110. In actuality, they would be wrapped around almost the entire circumference of the cylinder leaving a minimum amount of void space on the cylinder.

For reasons that will be described later the blade clamps 126, 128 may have ends 126' and 128', respectively, which overhang an end of cylinder 110 as shown in dashed lines in FIG. 9.

Referring again to FIGS. 6 and 7, the applicator or dispenser for applying the blade clamps 126, 128 to, and removing them from, cylinder 110 is shown generally at 132. The applicator comprises an elongated applicator bar 134 rotatably supported via shafts 135 at its opposite ends by a pair of standards 136 which extend down to a carriage 138. The applicator bar and carriage extend the entire length of cylinder 110. The carriage is slidably mounted to a fixed base 142 so that the carriage 138 can slide on base 142 toward and away from cylinder 110 between an extended position shown in the dotted lines in FIG. 8A which positions the applicator bar 134 close to the surface of the cylinder and a retracted position shown in solid lines in FIG. 8A wherein the applicator bar is spaced an appreciable distance away from the cylinder. The carriage is moved between its two positions by a linear actuator 144 mounted to base 142 and having and arm 144*a* connected to carriage 138. The operation of the actuator 144 is also controlled by controller 112.

The applicator bar 134 has a polygonal cross-section. That is, it has a plurality, herein six, of facets or faces 134*a*. Furthermore, magnets, which may be electromagnets controlled by controller 112, are mounted to selected ones of those faces. In accordance with the invention, there is a magnet corresponding to each blade clamp 126, 128 to be applied to cylinder 110. Thus in the illustrated apparatus, magnets are mounted to four of the applicator bar faces 134*a*, the magnets being identified as $\mathbf{146}_{RL}$, $\mathbf{146}_{RT}$, $\mathbf{146}_{DL}$ and $\mathbf{146}_{DT}$.

Further in accordance with the invention, means are provided for rotating the applicator bar 134 to selectively position the magnets 146 so as to face cylinder 110. In the illustrated apparatus, the bar 134 is rotated in the direction indicated by the arrow by a step motor 148 supported by a standard 152 extending up from carriage 138. The motor shaft carries a pulley 154 connected by an endless belt 156 to a pulley 158 fixed to the end of applicator bar shaft 135. Motor 148 is also controlled by controller 112.

Figure 8B:
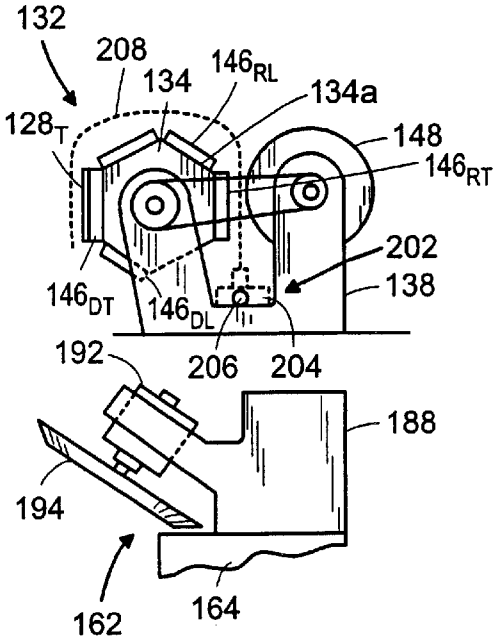
FIGS. 8A, 8B are alternative views similar to FIG. 7 illustrating the operation of the FIG. 6 mechanism.
Figure 8A:
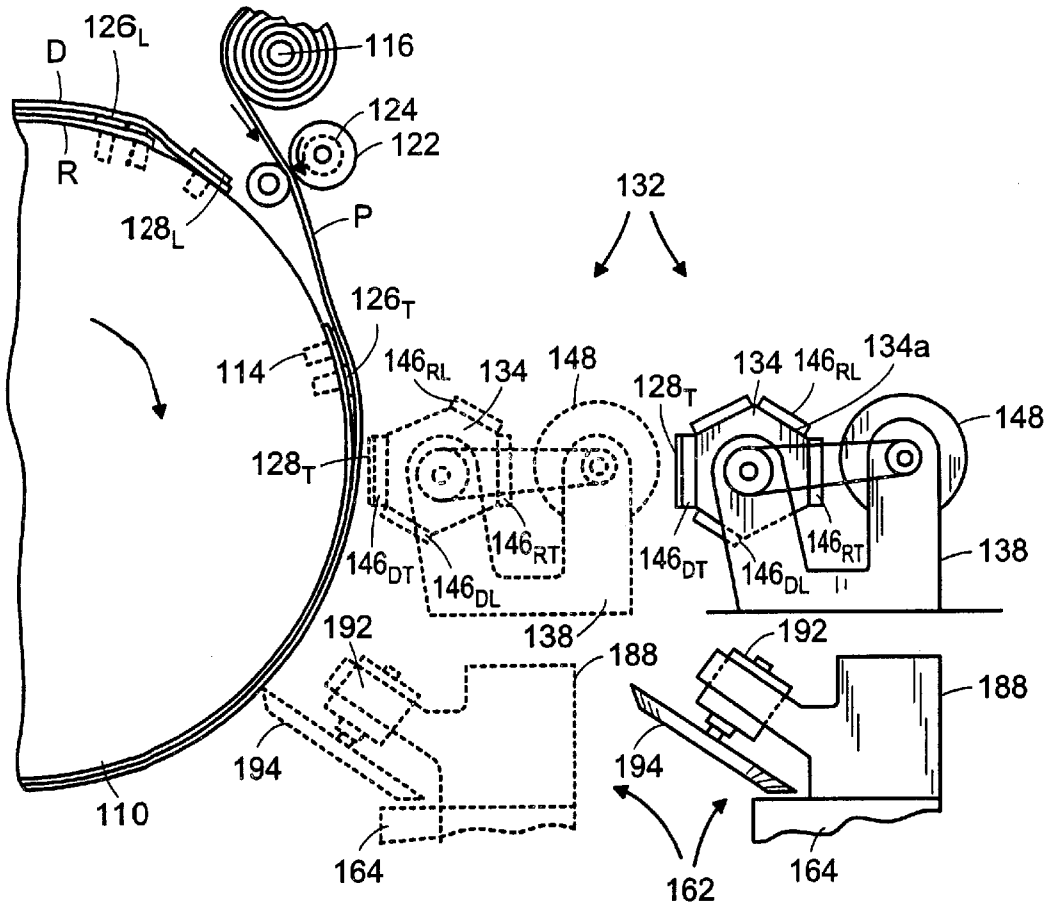

Still referring to FIGS. 6 and 7, the subject proofing apparatus also includes a cutting assembly shown generally 162 for severing the proofing material P to separate the receptor and donor sheets R and D shown in FIGS. 8A and 9 from the roll supply of proofing material P. As evident from FIG. 9, the cutting assembly 162 cuts the sheet material P just behind the clamps $\mathbf{126}_T$, $\mathbf{128}_T$ which clamp the trailing ends of the receptor and donor sheets to the cylinder 110.

Assembly 162 comprises a carriage 164 which is moved along a pair of guide rods 166 extending parallel to cylinder 110 by a lead screw 186 extending between the guide rods and threaded through the carriage. The opposite ends of the lead screw are rotatably mounted to the machine frame and the lead screw 186 is rotated under the control of controller 112 by a motor 187 (FIG. 6) mounted to the machine frame. The upper surface of carriage 164 forms slides 164*a* for a slider 188 so that the slider 188 can be moved relative to carriage 164 toward and away from cylinder 110.

Slider 188 includes a branch 188*a* which extends toward cylinder 110 and carries an electric motor 192 having a shaft 192*a* which rotates a circular cutting blade 194 under the control of controller 112. Slider 188 may be moved between an extended position shown in dotted lines in FIG. 8A wherein the edge of the cutting blade 194 contacts the surface of cylinder 110 and a retracted position shown in solid lines in FIG. 8A wherein the cutting blade 194 is spaced away from cylinder 110. The slider is moved between these two positions by a linear actuator 196 mounted to carriage 164 and whose armature 196*a* is connected to slider 188. Actuator 196 is also controlled by controller 112.

Before applying the receptor and donor sheets to cylinder 110, the proofing apparatus is initialized. For this, controller 112 causes actuator 144 to retract carriage 138. The controller also energizes the electromagnets so that the blade clamps 126, 128 can be magnetically adhered to the faces of the applicator bar as shown in FIG. 7. The controller 112 also controls the step motor 148 so that the blade clamp $\mathbf{126}_L$ faces cylinder 110 as shown in FIG. 7. Finally, the controller controls motor 187 to position the cutter carriage 164 adjacent to one end of cylinder 110. Upon receiving a START command via keyboard 112*a* controller 112 causes motor 124 to rotate feed roller 122 so that proofing material P is drawn from roll 116 until the leading edge of that material is located between cylinder 110 and applicator bar 134 as shown in FIG. 7. Next, the controller energizes actuator 144 causing the actuator to move carriage 138 to its extended position shown in dotted lines in FIG. 8A so that the blade clamp $\mathbf{126}_L$ facing cylinder 110 move sufficiently close to the cylinder magnets 114 underlying the leading edge of material P such that the blade clamp becomes attracted to those magnets. At this point, controller 112 de-energizes the magnet $\mathbf{146}_{RL}$ holding the blade clamp $\mathbf{126}_L$ to the applicator bar thereby releasing that blade clamp to cylinder 110 so as to clamp the leading edge of material P to the cylinder surface.

Following the application of the first blade clamp $\mathbf{126}_L$ to the cylinder, controller 112 retracts carriage 138 to its solid line position in FIG. 8A and rotates the applicator bar 134 to position the blade clamp $126_T$ opposite cylinder 110. At the same time, the controller controls the motor rotating the cylinder 110 under the influence of the timing signals from the cylinder shaft encoder (FIG. 1) to rotate cylinder 110 clockwise as viewed in FIG. 7 through a selected angle less than 360°, while controlling the rotation of feed roller 122 so that proofing material P is wrapped around the cylinder. Then, the controller causes the actuator 144 to move carriage 138 to it extended position so that the second blade clamp $126_T$ is magnetically engaged to cylinder 110 following which the controller de-energizes the magnet $146_{RT}$ holding that blade clamp to the applicator bar and retracts carriage 138.

Next, the controller causes the cylinder motor to rotate cylinder 110 in the direction of the arrow in FIG. 7 to position the blade clamp $126_T$ just applied to the cylinder slightly beyond or below the cutting blade 194 as viewed in FIG. 7. The controller then activates the blade motor 192 causing the cutting blade to rotate. The controller also energizes actuator 196 to move slider 188 to its extended position shown in dotted lines in FIG. 8 which places the edge of the cutting blade against the proofing material P on cylinder 110. Finally, the controller activates motor 187 which rotates lead screw 186 causing carriage 164 and the cutting blade 194 supported thereby to move along the entire length of the cylinder thereby severing the proofing material P just behind the blade clam $126_T$ so as to separate the proofing material wrapped around cylinder 110 from the material supply from roll 116. That wrap constitutes the receptor sheet R illustrated in FIGS. 8 and 9 whose leading end trailing edges are clamped to the cylinder 110 by blade clamps $126_L$ and $126_T$, respectively.

Preferably the blade clamps $126_L$ and $126_T$ holding the leading and trailing edges of the receptor sheet R to the cylinder are spaced apart leaving a gap or void space on cylinder 110 between those clamps. As we shall see, this space will be used to receive the blade clamps $128_L$ and $128_T$ which clamp the leading and trailing edges of the donor sheet D to the cylinder as shown in FIG. 9.

At this point, controller 112 again retracts carriage 138 and rotates the applicator bar 134 to position the third blade clamp $128_L$ opposite cylinder 110. The controller also retracts slider 188 and maintains the slider at one extreme position on the guide rods 166. The controller is also programmed to rotate motor 124 in the opposite or nonfeed direction to withdraw proofing material P back toward supply roll 116 until the leading edge of that material is located opposite the now operative blade clamp $128_L$. Then, the controller rotates cylinder 110 to a position that places the already-applied blade clamp $126_L$ just above the blade clamp $128_L$ on the applicator bar 134 that faces the cylinder.

Next, the controller causes the actuator 144 to extend carriage 138 so that the blade clamp $128_L$ is moved to the leading edge of the proofing material from roll 116 whereupon that blade clamp is magnetically attracted to the cylinder thereby clamping the proofing material to the cylinder. Following the deenergizing of the electromagnet 146DL holding that blade clamp to the applicator bar 134, the controller retracts carriage 138 and controls step motor 148 to rotate the applicator bar to position the fourth blade clamp $128_T$ opposite cylinder 110. At the same time, the controller rotates cylinder 110 and activates motor 124 causing additional proofing material P to be fed from roll 116 onto the cylinder to provide a second wrap which overlies the receptor sheet R present on that cylinder. The cylinder continues to rotate until the blade clamp $126_T$ magnetically clamped thereto is located just beyond or below the blade clamp $128_T$ still magnetically adhered to the applicator 134 bar. Thereupon, the controller extends carriage 138 and deenergizes the magnet $146_{DT}$ holding that blade clamp to the applicator bar so that the blade clamp 128T becomes magnetically attracted to cylinder 110 by the magnets 114 thereon.

At this point, the controller 112 retracts carriage 138 and rotates cylinder 110 and feed roller 122 until the blade clamp $128_L$ is positioned just below the cutting blade 194. Then, the controller activates the cutting mechanism 162 as before so that the rotating cutting blade 194 severs the proofing material P just behind the blade clamp $128_T$ thereby separating the donor sheet D (FIG. 9) from the roll supply. Finally, the controller retracts and deactivates the cutting assembly 162 and rotates the feed roll 122 in the opposite direction to withdraw the new leading edge of the material from roll 116 away from surface of cylinder 110. The donor and receptor sheets D and R clamped to cylinder 110 as shown in FIG. 9 are now ready to be processed in the usual way by the associated proofing apparatus.

Controller 112 may be programmed to rotate cylinder 110 by different amounts between the application of the blade clamps to the leading and trailing edges of the receptor and donor sheets. This will change the lengths of those sheets applied to the plate cylinder. The only requirement is that the void space on the cylinder left after application of the receptor sheet must be sufficiently wide to accommodate the blade clamps for the donor sheet.

After the proofing operation is completed and it is time to remove the donor and receptor sheets from the plate cylinder, the applicator 132 is operated in more or less the same way to remove the blade clamps 128, 126 from cylinder 110 and thereby release the donor and receptor sheets from the cylinder. More particularly, the controller rotates cylinder 110 to position the blade clamp $128_T$ opposite applicator bar 134 which is now is devoid of blade clamps and the controller extends carriage 138 while energizing the magnet 146 that is opposite the cylinder. The field produced by that magnet 146 is stronger than the field produced by the magnets 114 in the cylinder. Therefore, the blade clamp $128_T$ is disengaged from the cylinder and magnetically adhered to the applicator bar 134. Then, the controller retracts the carriage 138, rotates applicator bar 134 to position a second electromagnet 146 opposite cylinder 110 and energizes that magnet.

After the controller has rotated cylinder 110 to position the blade clamp 128L thereon opposite the applicator bar, the controller extends carriage 138 so that the operative magnet 146 attracts and removes that blade clamp $128_L$ from the cylinder. This releases the donor sheet D from the cylinder so that it can be replaced by another one.

If the receptor sheet R is also to be removed, the controller again retracts carriage 138 and rotates applicator bar 134 to position the next empty magnet 146 thereon opposite cylinder 110 while at the same time rotating the cylinder 110 to position the blade clamp $126_T$ opposite the applicator bar. Thereupon, the controller again extends carriage 138 and energizes that electromagnet so that the applicator bar picks up the blade clamp $126_T$ from the cylinder. One more cycle of the blade applicator 132 removes the final blade clamp $126_T$ from the cylinder thereby releasing the receptor sheet R from the cylinder.

Referring to FIG. 8B, as noted above, the magnets 146, instead of being electromagnets, may be permanent magnets. In this event, a stripper mechanism shown in dotted lines at 202 in FIG. 8B may be used to strip the blade clamps 126, 128 from cylinder 110. Stripper mechanism 202 comprises a slider 204 which may be slidably mounted on carriage 138 and moved along the carriage by suitable motive means 206 under the control of controller 112. For example, the motive means may comprise a driven endless belt or a motorized lead screw. Extending up from slider 204 is a curved finger or stripper member 208 which passes up and over applicator bar 134 and down into the gap between the retracted applicator bar 134 and cylinder 110.

When it is time to strip each blade clamp 126, 128 from the cylinder 110, the stripper mechanism may be activated by controller 112 to engage stripper member 208 under the overhanging end 126', 128' (FIG. 9) of each blade clamp. When the slider 204 is moved along the carriage 138, the stripper member 208 progressively lifts the blade clamp away from the cylinder and toward the confronting magnet 146 on applicator bar 134 with sufficient force to overcome the magnetic attraction of the blade clamp to the cylinder. Resultantly, the blade clamp adheres to the magnet 146. Thus, by the time slider 204 reaches the end of its travel along carriage 138, the entire blade clamp will have been removed from the cylinder 110 and magnetically adhered to the operative confronting magnet 146 on the applicator bar 134.

The FIGS. 6 to 9 invention embodiment has all of the attributes of the one shown in FIG. 1. It is further advantaged in that all of the blade clamps may be handled by a single blade applicator or dispenser. Therefore, it requires less room in the associated proofing, imaging or printing apparatus.

It will thus be seen that the objects set forth above, among those made apparent from the preceding description, are efficiently attained. Also, certain changes may be made in carrying out the above method and in constructions set forth without departing from the scope of the invention. For example, the travelling cutting blade 194 may be substituted by a hot wire movable toward and away from cylinder 110. Therefore, it is intended that all matter contained in the above description or shown in the accompanying drawings shall be interpreted as illustrative and not in a limiting sense.

It is also to be understood that the following claims are intended to cover all of the generic and specific features of the invention described herein.

What is claimed is:

1. A method of clamping a printing plate to a support surface comprising the steps of:

providing a plate support with a magnetic surface defining the support surface;

laying a printing plate having opposite edges on said surface;

depositing a first elongated ferromagnetic blade clamp on the plate so that the blade clamp is adjacent and parallel to one edge of the plate;

depositing a second elongated ferromagnetic blade clamp on the plate so that the second blade clamp is adjacent and parallel to the other edge of the plate whereby a magnetic attraction of the support surface for the blade clamps releasably clamps the plate to the support surface wherein each depositing step is accomplished by paying out each blade clamp from a roll of blade clamp while a radially outer end of the roll is fixed to the plate support and the roll is moved in one direction along the support surface; and removing the blade clamps from the support surface with sufficient force to overcome the magnetic attraction holding the blade clamps to the support surface thereby unclamping the printing plate from the support surface.

2. The method defined in claim 1 wherein the removing step includes rolling up the blade clamp on said roll while the roll is moved in the opposite direction along the support surface so that the blade clamp is peeled away from the support surface, and releasing the outer end of the roll from the plate support.

3. The method defined in claim 1 wherein the removing step includes:

positioning against the first blade clamp a first magnet which exerts a stronger magnetic force on the first blade clamp than the support surface;

moving the first magnet away from the support surface;

positioning against the second blade clamp a second magnet which exerts a stronger magnetic force on the second blade clamp than the support surface; and moving the second magnet away from the support surface.

4. The method defined in claim 1 wherein the removing step includes:

positioning a first magnet proximate to the first blade clamp;

mechanically lifting the first blade clamp from the support surface to the first magnet so that the first blade clamp magnetically adheres to the first magnet;

moving the first magnet away from the support surface;

positioning a second magnet proximate to the second blade clamp;

mechanically lifting the second blade clamp from the support surface to the second magnet so that the second blade clamp magnetically adheres to the second magnet; and moving the second magnet away from the support surface.

5. Apparatus for clamping leading and trailing edges of a printing plate to a support surface, the apparatus comprising:

a support surface for supporting the printing plate;

a first elongated blade clamp having opposite ends and for placement on the printing plate supported by the support surface so that the first blade clamp is adjacent and parallel to the leading edge of the plate;

a second elongated blade clamp having opposite ends and for placement on the printing plate adjacent and parallel to the trailing edge thereof, each blade clamp and the support surface being of a ferromagnetic material and at least one of the first and second blade clamps, on the one hand, and the surface, on the other hand, being magnetically attractive so that when the first and second blade clamps are moved to corresponding first and second positions relatively close to the support surface, they are attracted to that surface and magnetically clamp the leading and trailing edges of the printing plate on the support surface; and dispensing means for paying out each blade clamp from a roll of blade clamp while a radially outer end of the roll is fixed to the support surface and the roll is moved in one direction along the support surface thereby moving the blade clamps to and from the first and second positions.

6. The apparatus defined in claim 5 wherein the support surface comprises a substrate and a multiplicity of magnets embedded in the substrate.

7. The apparatus defined in claim 5 wherein each blade clamp is magnetized.

8. The apparatus defines in claim 5 wherein the support surface is magnetized.

9. The apparatus defined in claim 5 wherein the support surface comprises a cylindrical surface of a rotary plate cylinder having opposite ends and around which the printing plate may be wrapped.

10. The apparatus defined in claim 9 wherein one end of each blade clamp overhangs an end of the plate cylinder.

11. The apparatus defined in claim 9 wherein each blade clamp constitutes a thin, narrow, elongated metal strip.

12. The apparatus defined in claim 11 wherein each said strip is substantially flexible so as to permit each said strip to be rolled up in a roll.

* * * * *